United States Patent [19]

Nusbaum

[11] 3,949,834

[45] Apr. 13, 1976

[54] SAFETY NET AND ADJUSTABLE SUPPORT THEREFOR

[76] Inventor: Arthur Nusbaum, 16 Whitewood Road, Tenafly, N.J. 07670

[22] Filed: Mar. 19, 1975

[21] Appl. No.: 559,835

[52] U.S. Cl. ..... 182/138

[51] Int. Cl.[2] ..... A62B 1/22

[58] Field of Search ..... 182/138, 137, 113, 82; 256/59, 65

[56] References Cited

UNITED STATES PATENTS

| | | | |
|---|---|---|---|
| 2,687,863 | 8/1954 | Vogt | 52/298 |

FOREIGN PATENTS OR APPLICATIONS

| | | | |
|---|---|---|---|
| 65,656 | 11/1969 | Germany | 82/137 |
| 1,490,572 | 6/1967 | France | 182/138 |
| 1,435,582 | 3/1966 | France | 182/138 |
| 71,253 | 4/1959 | France | 182/138 |

*Primary Examiner*—Reinaldo P. Machado
*Attorney, Agent, or Firm*—Stoll and Stoll

[57] ABSTRACT

For use in conjunction with building construction, a safety net intended to be supported outwardly of the edges of the floors of the building, comprising a net fabric supported at its inner end by a bracket secured to the upper of two adjacent floors, and secured at its outer end to the top of an extension pole the bottom of which is supported in an adjustable pole bracket secured to the lower of the two adjacent floors. The adjustable pole bracket comprises a socket for the extension pole which is secured at its lower end in an adjustable base, being a substantially U-shaped bracket having spaced, parallel substantially vertical side flanges, a socket to receive the extension pole, a socket hinge bolt joining the socket in rotatable relationship to the side flanges of the bracket and an adjustable stop which, together with a permanent cross-member stop extending between the side flanges, permits the socket, and the pole secured therein, to rotate from a substantially vertical position to an angle from the vertical sufficient to support the net.

2 Claims, 9 Drawing Figures

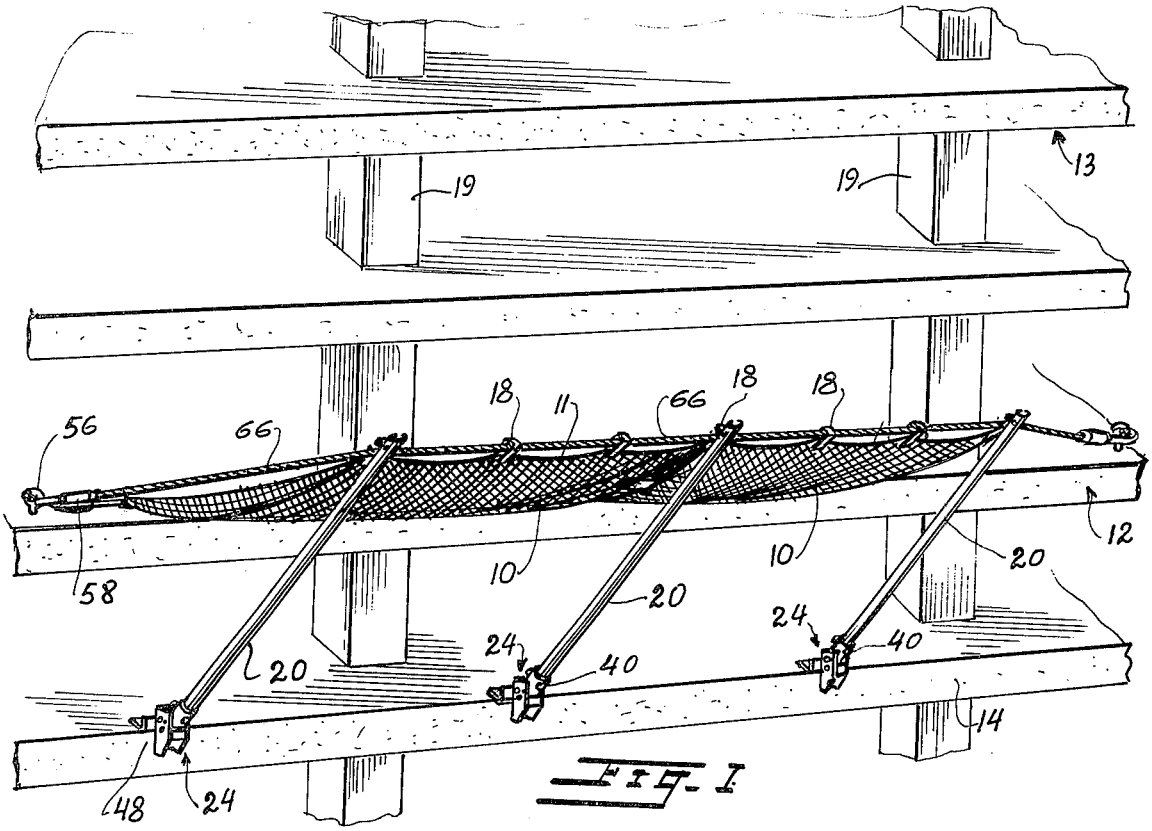
Fig. 1
Fig. 7
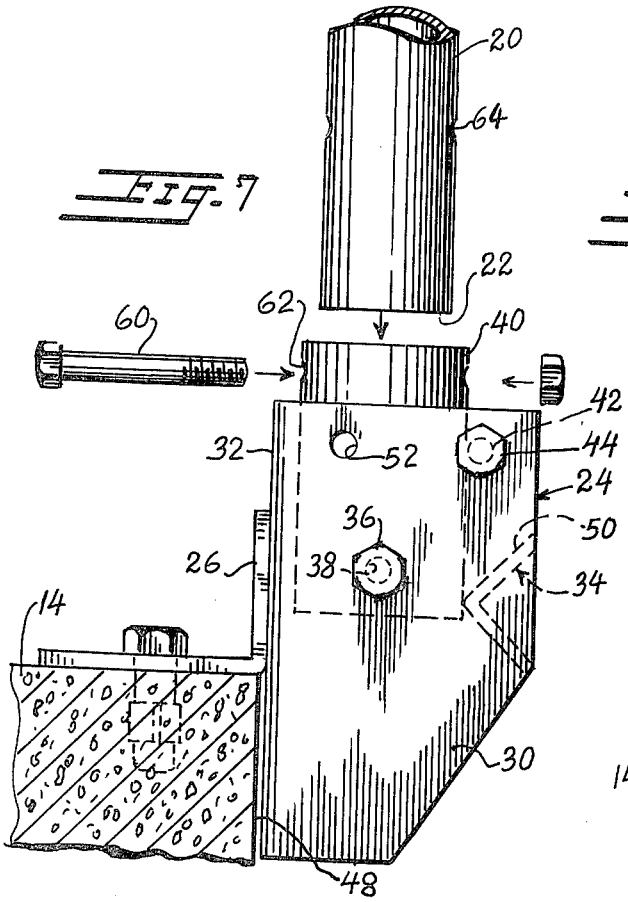
Fig. 8
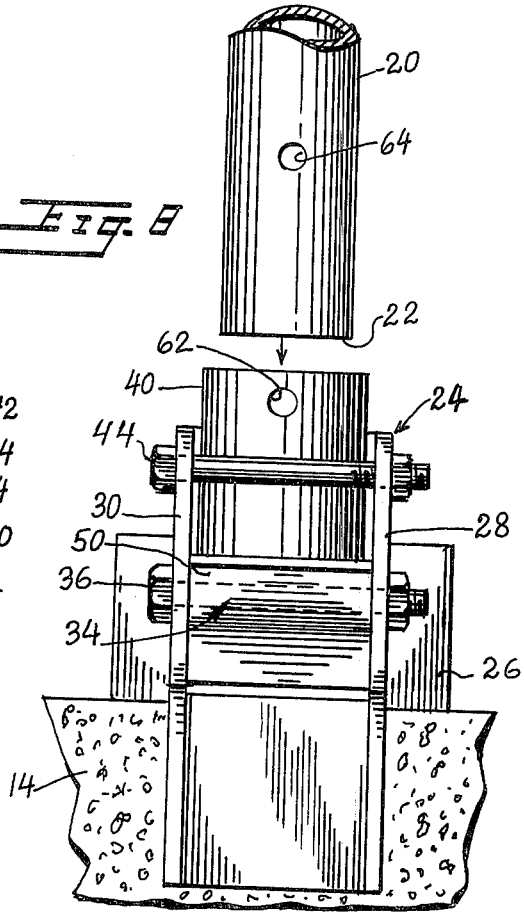

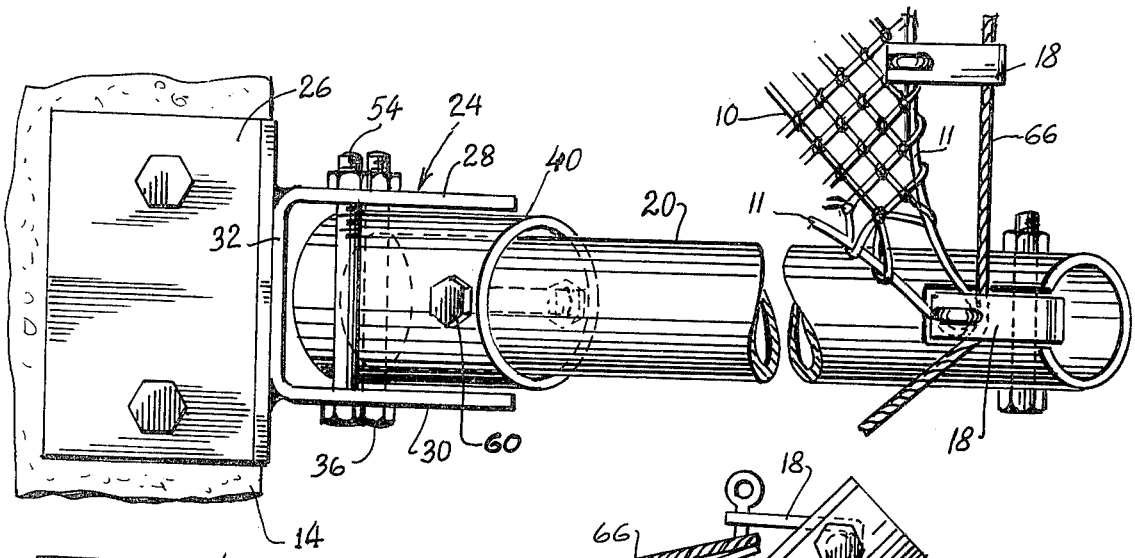
FIG. 4
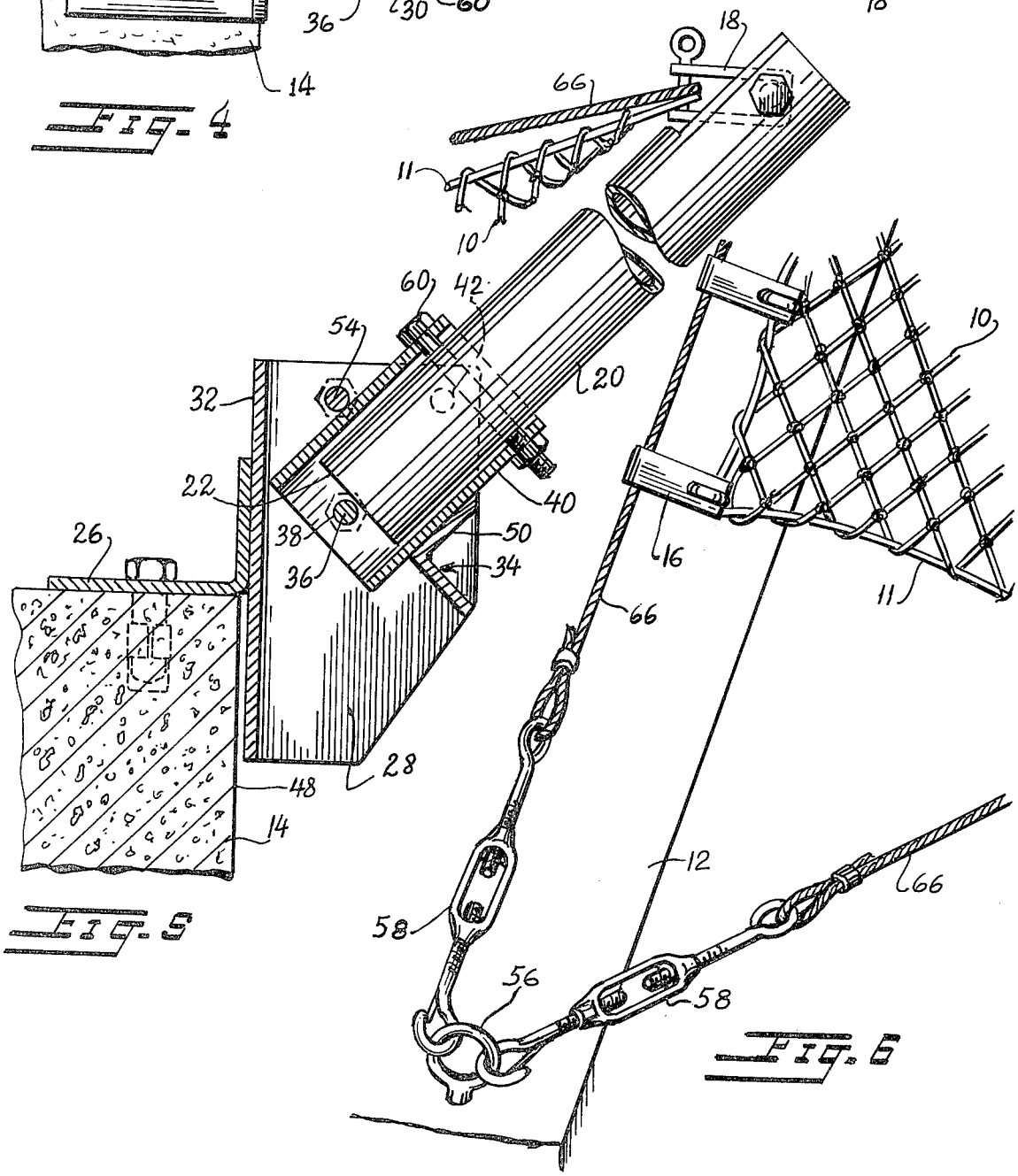
FIG. 5
FIG. 6

SAFETY NET AND ADJUSTABLE SUPPORT THEREFOR

BACKGROUND OF THE INVENTION

In conventional construction of commercial structures, it is accepted practice, frequently required under municipal building laws, to provide safety nets which extend outwardly from the ends of exposed floors to protect passers-by and workmen below the net from being injured by falling equipment and other objects. In extreme cases, such as construction in exposed conditions which may endanger the safety of workmen, the safety nets are strong enough to restrain a falling man.

The obvious problem is the manner in which a safety net may be secured outwardly from the edge of a floor. In conventional building construction where extreme safety net strength is not required, workmen frequently extend a plank of wood horizontally out past the edge of the floor and then wedge the inner end of the plank between floor and adjacent ceiling. A netting or wood platform is draped over the plank and over an adjacent series of planks. Clearly, such an arrangement is inefficient, and may be downright dangerous. In the many municipalities it is probably illegal.

SUMMARY OF THE INVENTION

Accordingly, the present invention provides a simplified means for rigidly securing a safety net outwardly of the floor ends in new building construction, or in any other suitable environment.

The present invention provides a means for securing such a safety net quickly, safely, conveniently and with ease of adjustment and removal.

Briefly, but not by way of limitation, the present invention provides a safety net which is extended out from the floor edge, the net being secured at its inner end to a bracket attached to an upper floor and being secured at its outer end to the top of an extension pole, the bottom of which is adjustably attached to the floor below. The bracket which secures the extension pole to the lower floor is so constructed as to permit the pole to be easily inserted from a vertical position. The pole is then secured in the vertical position and then netting is draped over the pole, being clamped to the top end of the pole. The vertical restraint is eliminated and the pole is permitted to be extended outwardly at the top, rotating about a hinge in the pole bracket, thereby drawing the netting with it. The outer end of the net is secured to the outer end of the pole and the inner end of the net is secured to a bracket on the upper floor of the building. The pole is then locked in its outward position to prevent it from rotating inwardly.

BRIEF DESCRIPTION OF THE DRAWING

FIG. 1 is a perspective view of the safety net and adjustable support therefor of the present invention shown in use on a building under construction.

FIG. 4 is an enlarged top view of the adjustable support of the present invention.

FIG. 5 is a cross-sectional view taken across line 5—5 of FIG. 4.

FIG. 6 is an enlarged perspective view of the end connection of the present invention.

FIG. 7 is an exploded side view of the adjustable bracket of the present invention showing the extension pole in position to be inserted into the bracket.

FIG. 8 is an exploded front view of the adjustable bracket as shown in FIG. 7.

DESCRIPTION OF A PREFERRED EMBODIMENT OF THE INVENTION

Figure 2:
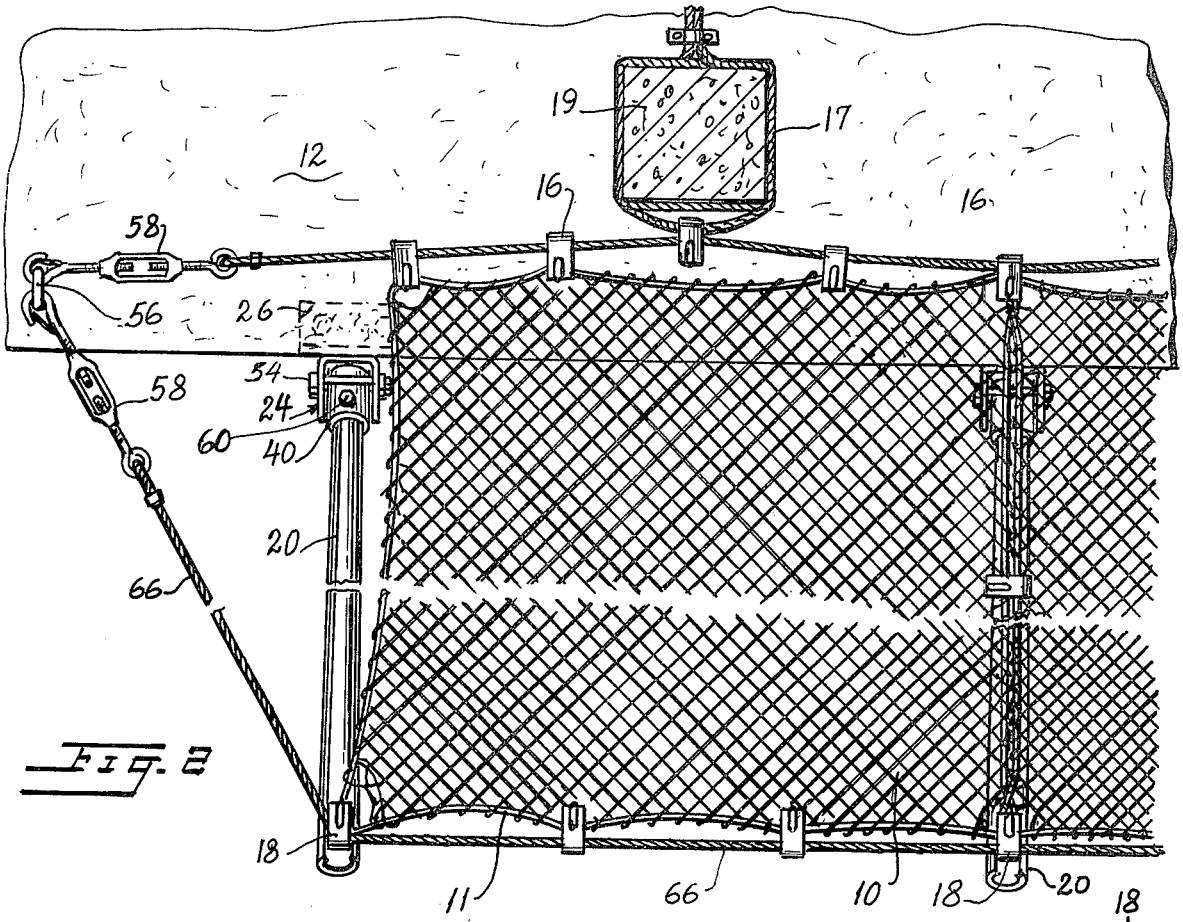
FIG. 2 is a top view, partially broken away, of the invention shown in FIG. 1.
Figure 3:
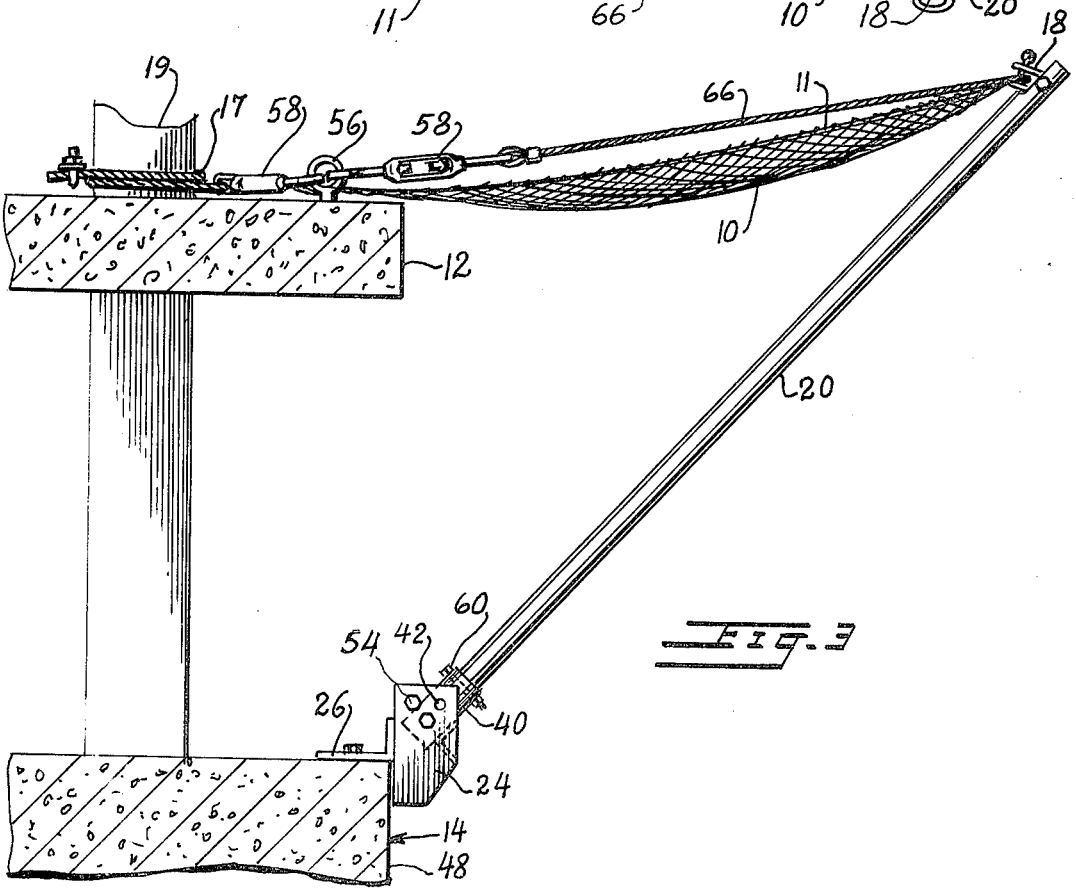
FIG. 3 is a side view of the invention shown in FIG. 1.

Referring the drawing, the safety net construction of the present invention comprises a net fabric 10, having a reinforced rope or cable edging 11, secured at its inner end to the upper floor 12 of a pair of adjacent floors 12 and 14, respectively, of a new building 13 by means of a suitable clamp, such as a screw pin shackle 16, clamping edging 11 to a length of cable 17 tied around a building column 19. The outer end of net fabric 10, being the end farthest from the edge of floor 12, is secured by means of a suitable clamp, such as a screw pin shackle 18 joining edging 11 to the upper end of a support pole 20. Support pole 20 is cantilevered outwardly of the building, with its lower end 22 hingedly secured to a base member 24 and fastened by means of a floor bracket 26 to lower floor 14.

Base 24 is a substantially U-shaped member having parallel side flanges 28 and 30 respectively, joined by a back member 32. Extending across base 24 from flange to flange and parallel to back member 32 is a cross-member 34 which may be any suitably strong restraining member. In the preferred embodiment, cross-member 34 is an angle channel as will be described.

Flanges 28 and 30 are provided each with three holes juxtaposed with three corresponding holes on the opposite flange, yielding three pairs of holes, each pair being adapted to receive cross bolts.

A socket hinge bolt 36 is secured across flanges 28 and 30, parallel to base 32, in the lowermost pair of holes 38 provided for the purpose in the flanges. Rotatably secured to hinge bolt 36 is an open end socket 40 which is adapted to receive lower end 22 of pole 20. The socket is rotatable about hinge bolt 36 as a substantially horizontal axis when bracket 24 is secured to floor 14 in the preferred position. Hinge bolt 36 passes through a pair of holes provided in opposite walls of the lower part of socket 40 such that socket 40 rotatably extends substantially upwardly and outwardly of hinge bolt 36. Accordingly, pole 20 may be placed into socket 40 until bottom 22 rests against hinge bolt 36 and pole 20 will rotate about hinge bolt 36 with socket 40. A second pair of holes 42 is provided for the purpose in flanges 28 and 30, in such location as to permit a second cross bolt 44 to engage against socket 40 when the socket is vertically aligned, that is, with its axis parallel to the plane of back member 32. Second cross bolt 44 accordingly acts as a stop holding socket 40 in the vertical position and prevents rotation of the socket about hinge bolt 36.

Accordingly, socket 40 is permitted to rotate about the horizontal axis of hinge bolt 36 in a plane which is perpendicular to the edge 48 of floor 14 against which back 32 rests. Such rotation of socket 40 is restricted, when the socket's axis is vertical, by second cross bolt 44 and is further limited, when the socket's axis is at an angle with respect to the vertical, by cross member 34 against which socket 40 rests. Cross member 34 has one of its angle channel flanges 50 plane-parallel to the axis of socket 40 when that axis is at the limit of its rotation away from the vertical about hinge bolt 36.

A third set of holes, being pair of holes 52, is provided in parallel flanges 28 and 30. A third pair of holes 52 is so located as to accept a third cross bolt 54 to be engaged against socket 40 when socket 40 is at its outermost limit of rotation, engaged against angle channel flange 50, thereby to prevent socket 40 from counter rotating back to the vertical. Socket 40 is locked against rotation between flange 50 and third cross bolt 54 and is accordingly secured at its angle with respect to the vertical.

In practice, it is not necessary to have both second cross bolt 44 and third cross bolt 54 as two separate elements since they can not be used simultaneously. One such bolt, secured to the bracket by a chain to prevent the bolt from falling to street level, may be used in second pair of holes 42 to secure socket 40 in its outermost rotated position.

The basic operation of the invention may now be seen. Socket 40 is held with its axis in a vertical position by cross bolt 44. A workman standing on upper floor 12 fastens net fabric 10 to upper floor 12 by any conventional and convenient means. By example, as shown in FIG. 2, a length of cable 17 may simply be secured about a building column 19, cable 17 in turn being clamped to a draw cable 66 which is in turn clamped to edging 11 of the net fabric. Edging 11 may also be clamped to any floor mounted securing member such as by shackle 18. Pole 20 is then inserted into socket 40 which is secured to lower floor 14. Second cross bolt 44 is inserted into second pair of holes 42 to secure pole and socket in the vertical position. The edge of net fabric 10 which is opposite the edge clamped to cable 17 is then draped over the top of pole 20 and secured by clamp 18 to the pole. Alternatively, another draw cable 66 may be clamped to the top of the pole and edging 11 of the net fabric is in turn clamped to the outer draw cable 66. Each section of net may conventionally be secured between two adjacent poles 20. Second cross bolt 44 is removed from bracket 30 and each pole 20 is permitted to gently rotate about hinge bolt 38 outwardly of upper floor 12 to the limit of rotation as permitted by cross member 34 and by the net fabric itself. In allowing the pole to rotate outwardly of the floor, the workmen will gently release the net to prevent the pole from rotating too quickly. Thus, one workman, standing on an upper floor, may extend a safety net outwardly of the floor edge by means of a pole supported on a lower floor. From the time pole 20 is inserted into socket 40, it is immediately secured in the socket by a forth cross bolt 60 placed through a pair of holes 62 on opposite sides of socket 40 and through a corresponding pair of holes 64 located for the purpose in opposite sides of the lower end 22 of support pole 20.

With support pole 20 in its outermost position, third cross bolt 54 is inserted to lock pole 20, socket 40 and net 10 in their outwardly extended positions.

Draw cables 66, clamped at spaced intervals to edging 11 of netting 10, provides a convenient means for adjusting tension of the net, preventing sag and securing the same to the building, as at eye bolt 56. Turn buckles 58 may be used to adjust tension in the draw cables or in other cable members.

In the event it is desired to have a long pole 20 extend considerably outward of the building edge, or in the event a heavy netting is used or it is likely that additional support will be necessary, a cable may be drawn from the top of each pole 20 to a floor above upper floor 12, thereby providing as much strength as is necessary.

It should be noted that a main advantage of the construction described is that netting 10 does not have any rigid members below it so that the net is free to flex to restrain a falling object or a person without damage to the falling object or person by striking the rigid member.

Figure 9:
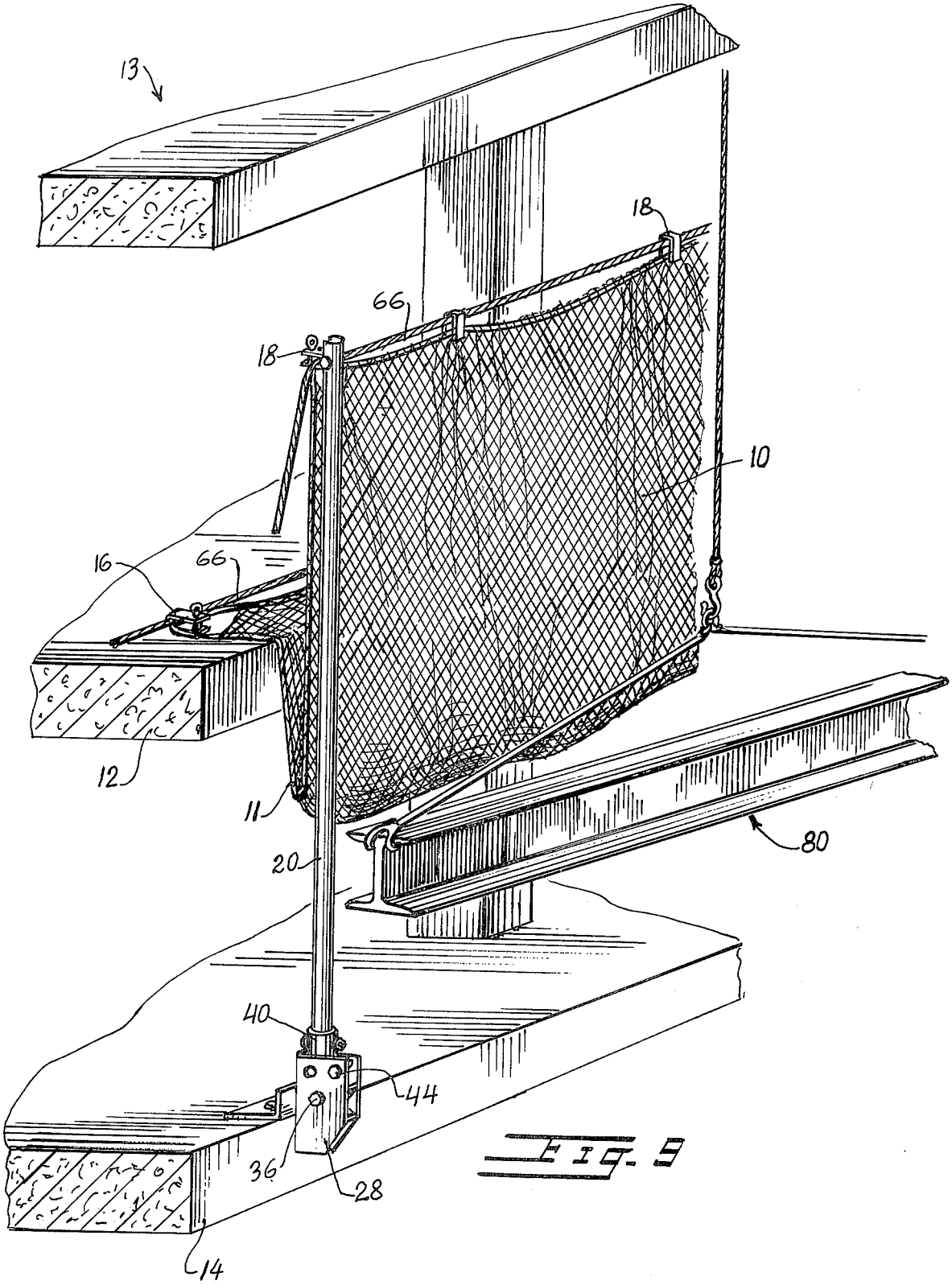
FIG. 9 is a perspective view of the net and support shown in a vertical position against the building edge to permit passage of a hoist load. This is also the position in which the system is assembled and removed.

Another advantage of the construction described is that netting 10 and support poles 20 may be brought back to the vertical position, such as is shown in FIG. 9 of the drawing, to temporarily permit a hoist load 80 to be drawn past floors 12 and 14. The simplicity of the invention permits the safety net to be repositioned in its outward orientation with ease and with complete security.

While the foregoing is illustrative of a preferred embodiment of the invention, it is clear that modifications and other embodiments may be had within the scope of the invention.

What is claimed is:

1. A safety net construction for multi-story buildings, comprising:

a. a bracket secured to the lower of two adjacent floors of the building, said bracket incorporating a pair of opposite parallel flanges extending outwardly of the floor;

b. a rotatable socket, said rotatable socket being hingedly secured between said flanges;

c. a support pole, said support pole being engaged by said socket for rotation therewith, d. whereby a safety net may be extended from an upper floor to the upper end of said support pole;

e. said bracket additionally comprising a cross member extending between said flanges;

f. said cross member engaging against said socket to prevent rotation of said socket relative to said bracket beyond the point of contact between said cross member and said socket, g. said bracket additionally comprising a cross bolt to hingedly secure said socket to said bracket for rotation with respect thereto, and h. said bracket additionally comprising a second cross bolt, said second cross bolt being located to engage against said socket when the axis of said socket is vertically aligned;

i. said second cross bolt preventing rotation of said socket with respect to said bracket.

2. A safety net construction for multi-story buildings in accordance with claim 1, wherein:

a. said bracket additionally comprises a third cross bolt, said third cross bolt being located so as to engage against said socket when said socket is engaged against said cross member, said third cross bolt being on the opposite side from said cross member, b. whereby said socket is locked against rotation between said cross member and said third cross bolt.

* * * * *